US008454395B2

(12) United States Patent
Xu et al.

(10) Patent No.: US 8,454,395 B2
(45) Date of Patent: Jun. 4, 2013

(54) ELECTRICAL CONNECTOR HAVING IMPROVED CONTACT MEMBER

(75) Inventors: Zheng-Hua Xu, Kunshan (CN); Jin-Jiang Zhang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/336,456

(22) Filed: Dec. 23, 2011

(65) Prior Publication Data

US 2012/0164862 A1 Jun. 28, 2012

(51) Int. Cl.
*H01R 11/22* (2006.01)

(52) U.S. Cl.
USPC ..... 439/852; 439/675

(58) Field of Classification Search
USPC ..... 439/253, 394, 585, 760, 578, 852, 439/675
See application file for complete search history.

(56) References Cited

U.S. PATENT DOCUMENTS

| | | | | | |
|---|---|---|---|---|---|
| 2,704,357 | A | * | 3/1955 | Johnson | 439/750 |
| 3,054,083 | A | * | 9/1962 | Aymar | 439/750 |
| 3,525,973 | A | * | 8/1970 | Kipnes | 439/353 |
| 3,611,271 | A | * | 10/1971 | Knapp | 439/583 |
| 3,678,444 | A | * | 7/1972 | Stevens et al. | 439/551 |
| 4,035,045 | A | * | 7/1977 | Trevithick | 439/101 |
| 5,011,440 | A | * | 4/1991 | Lee | 439/857 |
| 5,033,982 | A | * | 7/1991 | Lucas | 439/750 |
| 5,971,770 | A | * | 10/1999 | Richmond | 439/63 |
| 5,980,326 | A | * | 11/1999 | Weidner et al. | 439/675 |
| 6,491,530 | B2 | * | 12/2002 | Koide et al. | 439/92 |
| 7,488,211 | B2 | * | 2/2009 | Yamaoka | 439/595 |
| 7,510,436 | B2 | * | 3/2009 | Peng | 439/581 |
| 7,553,187 | B2 | * | 6/2009 | Feldman et al. | 439/607.17 |
| 8,172,617 | B2 | * | 5/2012 | Peng | 439/620.03 |

FOREIGN PATENT DOCUMENTS

CN 201142405 10/2008

* cited by examiner

*Primary Examiner* — Neil Abrams
*Assistant Examiner* — Travis Chambers
(74) *Attorney, Agent, or Firm* — Wei Te Chung; Ming Chieh Chang

(57) ABSTRACT

An electrical connector (100) for mating with a mating connector includes a housing (1) defining a receiving cavity (10), a rear insulator (32), a central pin (7), a front insulator (31) and a contact member (5) received in the receiving cavity. The contact member includes a first through fourth side walls (513*a*-513*d*) surrounding an inserting slot (514), a pair of resilient beams (515) respectively bent from the second and the fourth side walls toward the inserting slot for clasping the mating connector. The first side wall includes a first edge portion (511) having a first protrusion (519) and a first cutout (518) in front of the first protrusion, and a second edge portion (512) having a second protrusion (516) engaged with the first cutout and a second cutout (517) behind the second protrusion and engaged with the first protrusion.

17 Claims, 4 Drawing Sheets

ELECTRICAL CONNECTOR HAVING IMPROVED CONTACT MEMBER

BACKGROUND OF THE INVENTION

1. Field of the Invention

The present invention relates to an electrical connector, and more particularly to a RF (Radio Frequency) connector for application in high speed signal transmission.

2. Description of Related Art

CN Patent No. 201142405Y issued to Hon Hai on Oct. 29, 2008 discloses an RF connector having an outer conductor defining a receiving room, a contact element received in the receiving room for mating with a complementary connector. The contact element includes a tubular portion having two punched half-annular side walls and an opposite portion forming an inner cavity. The opposite portion of the contact element has a cantilever spring-tab located in the inner cavity. The spring-tab has a curved portion extending into the inner cavity of the contact element. The spring-tab further has a contact portion formed on a free end of the curved portion for electrically contacting with the complementary connector.

The two punched side walls are further engaged with each other by welding at a seam therebetween but the opposite portion, though also stamped and formed to leave a seam, is not subject to welding operation.

An electrical connector having an improved contact member is desired.

SUMMARY OF THE INVENTION

Accordingly, an object of the present invention is to provide an electrical connector having a contact member connected with the complementary connector reliably.

In order to achieve the object set forth, an electrical connector for mating with a mating connector includes a housing defining a receiving cavity, a rear insulator, a central pin, a front insulator and a contact member received in the receiving cavity. The contact member includes a first through fourth side walls surrounding an inserting slot, a pair of resilient beams respectively bent from the second and the fourth side walls toward the inserting slot for clasping the mating connector. The first side wall includes a first edge portion having a first protrusion and a first cutout in front of the first protrusion, and a second edge portion having a second protrusion engaged with the first cutout and a second cutout behind the second protrusion and engaged with the first protrusion.

The engagement between the first protrusions and the second cutouts and the engagement between the second protrusions and the first cutouts are strong enough to maintain the mating connector electrically connected with the contact member and the central pin reliably.

Other objects, advantages and novel features of the invention will become more apparent from the following detailed description when taken in conjunction with the accompanying drawings.

DETAILED DESCRIPTION OF THE PREFERRED EMBODIMENT

Figure 1:
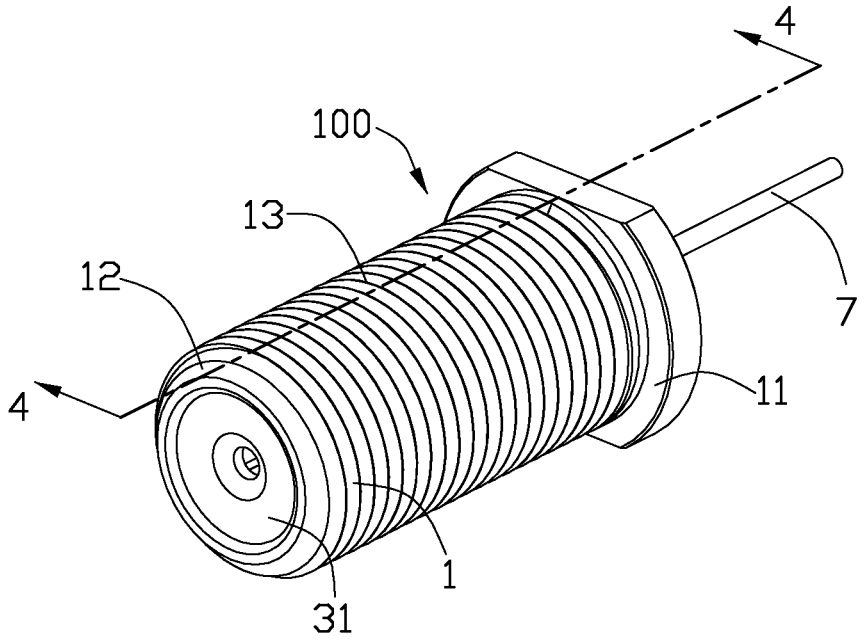
FIG. 1 is an assembled perspective view showing an electrical connector in accordance with the present invention.
Figure 2:
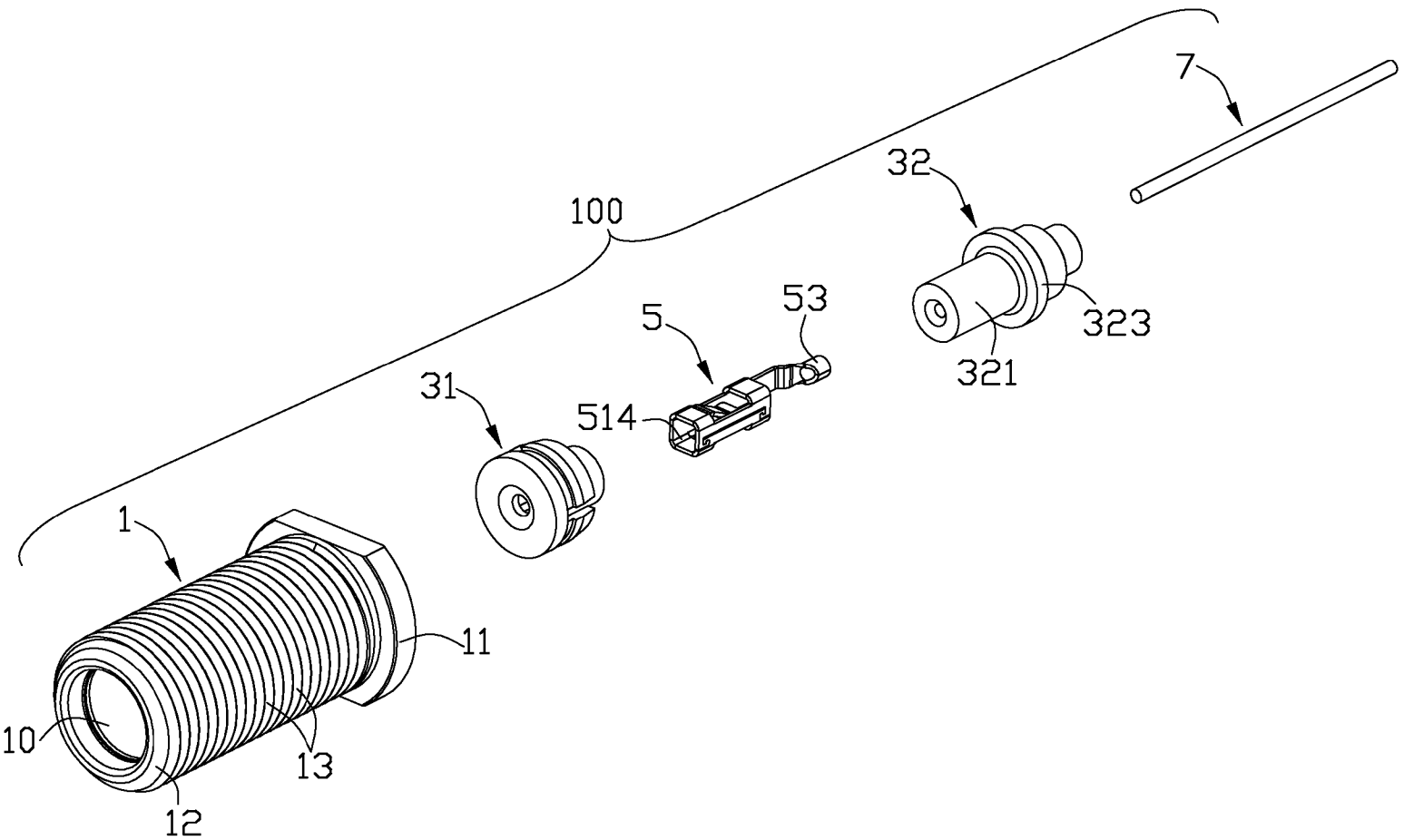
FIG. 2 is an exploded perspective view showing the electrical connector.
Figure 3:
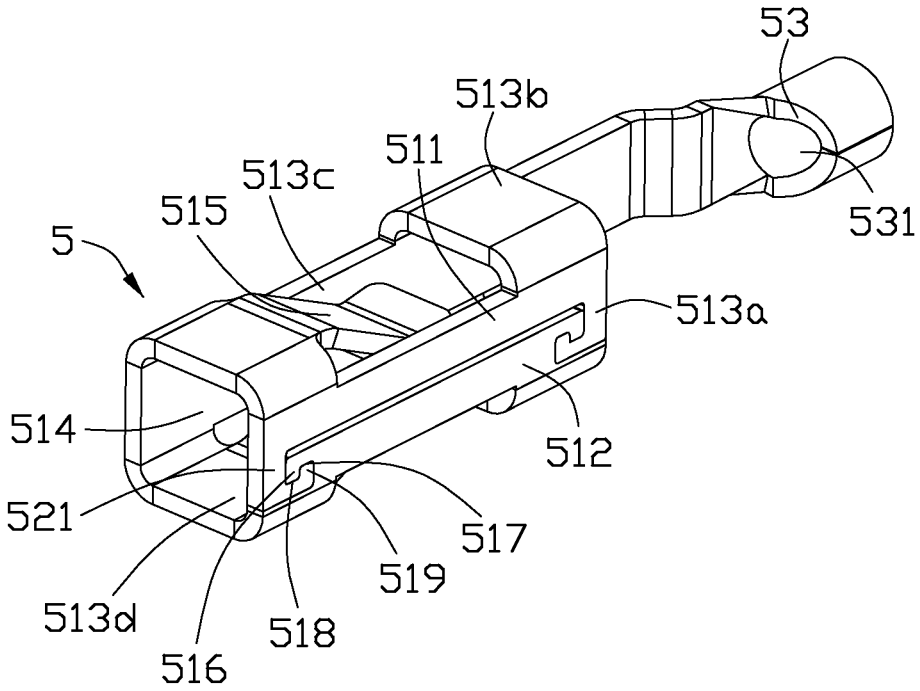
FIG. 3 is a perspective view showing a contact member.
Figure 4:
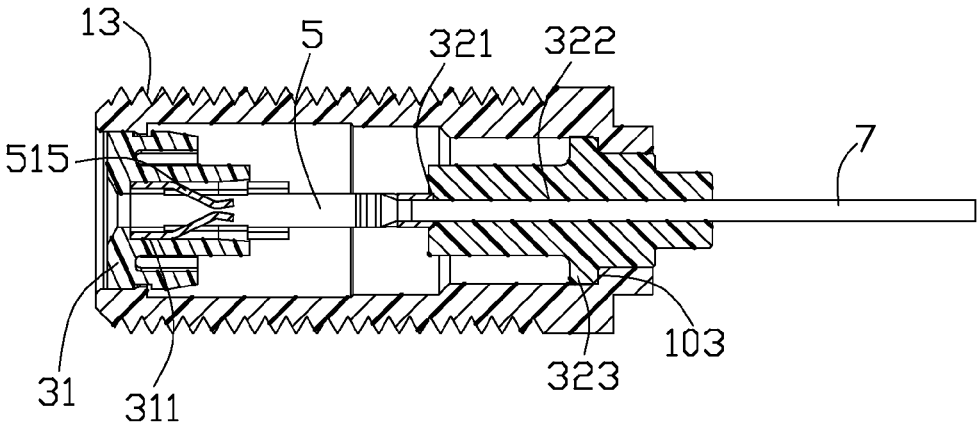
FIG. 4 is a cross-sectional view of the electrical connector, taken along line 4-4 of FIG. 1.

Reference will now be made in detail to the preferred embodiment of the present invention. Referring to FIGS. 1-4, an electrical connector 100 is an RF connector and includes a housing 1 defining a receiving cavity 10, a rear insulator 32 received in the receiving cavity 10, and a central pin 7 secured in the rear insulator 32, a front insulator 31 received in the receiving cavity 10, a contact member 5 punched from a metal sheet and secured in the front insulator 31 for connecting with the central pin 7.

The housing 1 comprises a base portion 11 and a sleeve portion 12 extending forwardly from the base portion 11. The sleeve portion 12 has a plurality of whorls 13 formed on an outer surface of the sleeve portion 12. The housing 1 has a shoulder portion 103 formed in the receiving cavity 10 adjacent to the base portion 11.

The rear insulator 32 includes a body portion 321, an accommodating slot 322 defined in the body portion 321 and an annular rib 323 projecting outwardly from an outer side of the body portion 321.

The front insulator 31 defines a rectangular securing slot 311.

The contact member 5 is punched from a metal sheet and includes a first through fourth side walls 513*a*, 513*b*, 513*d*, 513*d*, an inserting slot 514 defined by the first through fourth side walls 513*a*-513*d* for insertion of a mating connector (not shown), a pair of resilient beams 515 respectively bent from the second and the fourth side walls 513*b*, 513*d* toward the inserting slot 514 for clasping the mating connector. The contact member 5 has a tail portion 53 extending rearwardly from the third side wall 513*c* and defining a connecting hole 531.

The first side wall 513*a* comprises a first edge portion 511 and a second edge portion 512 mainly disposed below the first edge portion 511. The first edge portion 511 has a pair of symmetrical first protrusions 519 and a pair of first cutouts 518 symmetrically defined at outer sides of the pair of first protrusions 519, respectively. The second edge portion 512 has a pair of symmetrical second protrusions 516 and a pair of second cutouts 517 symmetrically defined at inner sides of the pair of second protrusions 516, respectively. The first edge portion 511 has a pair of L-shaped first beams 521. Each first beam 521 extends downwardly below the second protrusion 516 to connect with the first protrusion 519. The second protrusions 516 are engaged with the first cutouts 518 and the second cutouts 517 are engaged with the first protrusions 519, respectively.

In assembling of the electrical connector 100, the central pin 7 is inserted in the accommodating slot 322 of the rear insulator 32. The second insulator 32 together with the central pin 7 is inserted in the receiving cavity 10 of the housing 1, with the annular rib 323 resisting against the shoulder portion 103. The contact member 5 is secured in the securing slot 311 of the front insulator 31. The front insulator 31 together with the contact member 5 is inserted in the receiving cavity 10 of the housing 1, with the front insulator 31 disposed in front of the rear insulator 32. The central pin 7 has a front end inserted in the connecting hole 531 of the tail portion 53.

The engagement between the first protrusions 519 and the second cutouts 517 and the engagement between the second protrusions 516 and the first cutouts 518 are strong enough to maintain the mating connector electrically connected with the central pin 7 reliably. The rectangular contact member 5 is confined in the rectangular securing slot 311 for avoiding rotation of the contact member 5 in relative to the front insulator 31.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mating with a mating connector comprising:

a housing defining a receiving cavity;

a rear insulator received in the receiving cavity and defining an accommodating slot;

a central pin secured in the accommodating slot of the rear insulator;

a front insulator confined in the receiving cavity; and a one-piece contact member secured in the front insulator and connected with the central pin, said one-piece contact member being punched from a metal sheet and including a first through fourth side walls surrounding an inserting slot, a pair of resilient beams respectively bent from the second and the fourth side walls toward the inserting slot for clasping the mating connector, said first side wall being perpendicular to the second and the fourth side walls and comprising a first edge portion having a first protrusion and a first cutout in front of the first protrusion, a second edge portion having a second protrusion engaged with the first cutout and a second cutout behind the second protrusion and engaged with the first protrusion, and a seam between the first and second edge portions and extending along a front-to-back direction, said first protrusion projecting toward said seam, said second protrusion projecting away from said seam, said first and second protrusions aligned with each other along said front-to-back direction.

2. The electrical connector as claimed in claim 1, wherein said first edge portion has another first protrusion and another first cutout behind said another first protrusion, and the second edge portion has another second protrusion engaged with said another first cutout and another second cutout in front of said another second protrusion and engaged with said another first protrusion.

3. The electrical connector as claimed in claim 1, wherein said front insulator defines a rectangular securing slot, and said contact member is formed into a rectangular configuration secured in the securing slot.

4. The electrical connector as claimed in claim 1, wherein said contact member comprises a tail portion defining a connecting hole for insertion of the central pin.

5. The electrical connector as claimed in claim 1, wherein said first edge portion, except for the first protrusion, is mainly disposed above the second edge portion.

6. The electrical connector as claimed in claim 5, wherein said first edge portion has a L-shaped first beam extending downwardly below the second protrusion to connect with the first protrusion.

7. An electrical connector for use with a complementary connector, comprising:

an insulative housing defining a passageway;

a one-piece metallic electrical contact stamped from sheet metal and bent to form a tubular contacting section for receiving a corresponding terminal of the complementary connector in a front-to-back direction, said tubular contacting section having opposite first and second walls in a first transverse direction perpendicular to said front-to-back direction, and opposite third and fourth walls in a second transverse direction perpendicular to both said front-to-back direction and said first transverse direction, said opposite first and second walls and said opposite third and fourth walls commonly defining a rectangular cross-sectional configuration, the opposite first and second walls defining a pair of openings with a pair of resilient arms therein, and one of said opposite third and fourth walls defines a seam where two opposite edges of the contacting section extending essentially along said front-to-back direction are interlocked with each other at two spaced portions of the contacting section in said first transverse direction, said two spaced portions symmetrically located by two ends of the opening in the front-to-back direction and proximate to two opposite ends of the seam.

8. The electrical connector as claimed in claim 7, wherein said two spaced portions of the contacting section are located offset from the opening in the first transverse direction.

9. The electrical connector as claimed in claim 8, wherein one of said two opposite edges defines a recess to receive the other.

10. The electrical connector as claimed in claim 8, wherein a tail section extends rearwardly from the other of said third and fourth walls to secure a wire thereto.

11. The electrical connector as claimed in claim 8, wherein each of said two spaced portions defines a complementarily interengaging structure to perform interlocking function.

12. The electrical connector as claimed in claim 11, wherein the complementarily interengaging structures on said two spaced portions are symmetrical with each other as mirror images in opposite orientations.

13. An electrical connector for use with a complementary connector, comprising:

an insulative housing defining a passageway;

a metallic electrical contact stamped from sheet metal and bent to form a tubular contacting section for receiving a corresponding terminal of the complementary connector in a front-to-back direction, said tubular contacting section having opposite first and second walls in a first transverse direction perpendicular to said front-to-back direction, and opposite third and fourth walls in a second transverse direction perpendicular to both said front-to-back direction and said first transverse direction, said opposite first and second walls and said opposite third and fourth walls commonly defining a rectangular cross-sectional configuration, the opposite first and second walls defining, around a middle portions, a pair of openings with a pair of resilient arms therein, and one of said opposite third and fourth walls defines a seam where two opposite edges of the contacting section extending essentially along said front-to-back direction are interlocked with each other in said first transverse direction; wherein said seam essentially includes a long center horizontal segment and a pair of short outer horizontal segments at two opposite ends along said front-to-back direction with a pair of interlocking segments respectively located between the long center horizontal segment and the pair of corresponding short outer horizontal segments; wherein in a side view, the long center horizontal segment extends beyond the opening so as to have the pair of interlocking segments located outside of the opening along the front-to-back direction.

14. The electrical connector as claimed in claim 13, wherein in the side view, said two interlocking segments are symmetrically located by two ends of the opening in the front-to-back direction.

15. The electrical connector as claimed in claim 13, wherein the long center horizontal segment extends along a centerline of said one of the opposite third and fourth walls.

16. The electrical connector as claimed in claim 13, wherein said interlocking segment defines a 90 degrees rotated, S-shaped configuration.

17. The electrical connector as claimed in claim 13, wherein a tail section extends rearwardly from the other of said opposite third and fourth walls to secure a wire.

* * * * *